US006722149B1

(12) United States Patent
Saroka et al.

(10) Patent No.: US 6,722,149 B1
(45) Date of Patent: Apr. 20, 2004

(54) REFRIGERATED DISPLAY MERCHANDISER

(75) Inventors: Mary D. Saroka, Manchester, CT (US); Abbas A. Alahyari, Manchester, CT (US)

(73) Assignee: Carrier Commercial Refrigeration, Inc., Aurora, IL (US)

( * ) Notice: Subject to any disclaimer, the term of this patent is extended or adjusted under 35 U.S.C. 154(b) by 0 days.

(21) Appl. No.: 10/337,591

(22) Filed: Jan. 7, 2003

(51) Int. Cl.[7] ..... A47F 3/04
(52) U.S. Cl. ..... 62/256; 454/193
(58) Field of Search ..... 62/256; 454/193

(56) References Cited

U.S. PATENT DOCUMENTS 3,289,432 A * 12/1966 Brennan et al. ..... 62/256
3,392,544 A * 7/1968 Perez ..... 62/256
3,648,482 A 3/1972 Beckwith et al.
3,827,254 A 8/1974 MacMaster et al.
3,850,003 A 11/1974 Beckwith et al.
3,937,033 A 2/1976 Beckwith et al.
4,267,706 A 5/1981 Abraham
4,633,677 A 1/1987 Maehara
5,345,778 A 9/1994 Roberts
5,357,767 A 10/1994 Roberts
6,367,274 B1 * 4/2002 Mellado ..... 62/256

* cited by examiner

*Primary Examiner*—William E. Tapolcai

(57) ABSTRACT

A refrigerated merchandizer includes a display case defining a product display region having an open-front isolated from the ambient air of the store by means of a downwardly directed inner air curtain of relatively cold refrigerated air and a downwardly directed outer air curtain of relatively warmer air. The outer curtain of relatively warmer air is directed downwardly and outwardly away from the inner air curtain of relatively cold air at a divergent angle with respect to the inner air curtain.

8 Claims, 2 Drawing Sheets

REFRIGERATED DISPLAY MERCHANDISER

BACKGROUND OF THE INVENTION

The present invention relates generally to refrigerated display merchandisers of the type used in supermarkets, mini-marts, convenience stores and other commercial establishments for displaying and merchandising refrigerated or frozen products for sale. More particularly, the present invention relates to open-front refrigerated display merchandisers of the type wherein a curtain of cold refrigerated air is passed downwardly across the open front product display region of the merchandiser.

Refrigerated display merchandisers, also commonly referred to as display cases, having open front display regions are commonly used in supermarkets, mini-marts, convenience stores and other commercial establishments for displaying and merchandising refrigerated or frozen products for sale. The open front nature of such display cases permits the consumer to simply reach into the product display region to select and remove a product for purchase without the inconvenience of needing to open a door to access the product. Customarily, a curtain of cold refrigerated air is passed downwardly at a relatively high velocity across the open front of the display case to form an invisible boundary between the product display region and the region of the store in front of the display case. This air curtain not only helps retain cool refrigerated air within the product display region of the display case, thereby cooling the display product on the shelves of the display case, but also functions to isolate, to a certain extent, the product display region from the ambient air within the store. Ambient air that does enter into open product display region undesirably causes increased energy consumption by increasing the cooling demand on the refrigeration system associated with the display case. Further, such ambient air may also cause a local temperature rise within the product display region sufficient to result in an undesirable rise in product temperature that could adversely impact upon product quality.

A problem encountered with when passing a curtain of refrigerated air downwardly across the open front of the product display region of the display case lies in the entrainment of ambient air into the stream of refrigerated air forming the air curtain. Turbulence exists at the boundary between the relatively high velocity curtain air and the generally quiescent ambient air lying in front of the display case. As a result of such turbulence, some ambient air is undesirably entrained into the air curtain. Multiple air curtain display cases have been developed in the prior art to address this entrainment problem. For example, display cases having two adjacent, parallel, but independently generated, air curtains of refrigerated air are common in the art. Typically, such as disclosed by Maehara in U.S. Pat. No. 4,633,677, the outermost air curtain has a slightly higher temperature than the innermost air curtain, so as to protect the colder innermost air curtain from the impact of ambient air entrainment. However, such designs do not completely eliminate the intrusion of ambient air into the refrigerated air curtain.

Also, it is well known in the art to establish a third air curtain of relatively high velocity ambient air outwardly of one or two refrigerated air curtains as a means of reducing entrainment of ambient air from the store into the refrigerated air curtains. Abraham, in U.S. Pat. No. 4,267,706, discloses establishing an ambient air curtain outwardly of an innermost refrigerated air curtain, with the outer ambient air curtain being directed downwardly parallel to and adjacent to the inner refrigerated air curtain. Beckwith et al, in U.S. Pat. Nos. 3,648,482 and 3,850,003, MacMaster et al, in U.S. Pat. No. 3,827,254 and Roberts, in U.S. Pat. No. 5,345,778, each disclose establishing an ambient air curtain outwardly of a pair of refrigerated air curtains. The curtain closest the product display region of the display case is coolest, while the center curtain is at a temperature slightly warmer than the innermost curtain, but substantially cooler than the outermost ambient air curtain. The center curtain of warmer refrigerated air serves to buffer the innermost colder refrigerated air curtain from warm air intrusion from the outermost ambient air curtain. The outermost curtain of ambient air is directed substantially vertically downwardly, either parallel to and adjacent the center air curtain or slightly inwardly toward the center air curtain, so as to preclude refrigerated air from the center and innermost refrigerated air curtains from spilling out of the product display region of the display case. The outermost ambient air curtain itself ideally spills into the store near the base of the display case so as to not be drawn into the air return inlets through which the refrigerated air curtains return to the evaporator compartment. Although generally quite effective in reducing intrusion of ambient air into the colder innermost refrigerated air curtain, some intrusion into the center refrigerated air stream will occur. Further, providing three separate air flow circuits fro generating the three independent air streams increases the complexity and cost of the display case. Consequently, a need exists for a refrigeration system that addresses the problem encountered by the interaction of warm air outside of the display case and the air curtain without significant expense.

SUMMARY OF THE INVENTION

Accordingly, it is an object of the present invention to provide a refrigerated merchandiser including an improved performance multi-layer air curtain system. It is a further object of the present invention to provide a refrigerated merchandiser including a multi-layer air curtain system that is relatively less expensive than other multi-layer air curtain refrigerated merchandisers.

The refrigerated merchandiser of the present invention includes a display defining a product display region having an open-front isolated from the ambient air of the store by means of a downwardly directed inner air curtain of relatively cold refrigerated air and a downwardly directed outer air curtain of relatively warmer air. In accordance with the present invention, the outer curtain of relatively warmer air is directed downwardly and outwardly away from the inner air curtain of relatively cold air at a divergent angle with respect to the inner air curtain. In a preferred embodiment, the outer air curtain of relatively warmer air is directed downwardly and outwardly away from the inner air curtain at a divergent angle of about 5 degrees to about 55 degrees, and more advantageously at a divergent angle of about 25 degrees to about 50 degrees, and even more advantageously at an angle about 35 degrees to about 45 degrees.

The display case of the refrigerated merchandiser of the present invention has a first air outlet disposed in its top panel that directs relatively cold refrigerated air from the merchandiser's refrigeration compartment, cooled in a conventional manner, downwardly across the open-front viewing area of the display case to form an innermost air curtain. In addition to this first air outlet, a second air outlet is provided outwardly of the first air outlet to guide relatively warmer air generally downwardly to form an outer air curtain across the same viewing area. However, in contrast to conventional refrigeration display cases, the second air outlet includes guide vanes for directing the outer air curtain outwardly away from the inner air curtain at a divergent angle. The guide vanes may be permanently set at a predetermined divergent angle, or may be adjustable between a range of divergent angles so as to permit in-store optimumization.

BRIEF DESCRIPTION OF THE DRAWINGS

The various features and advantages of this invention will become apparent to those skilled in the art from the following detailed description of the currently preferred embodiment with reference to the accompany drawings wherein.

DETAILED DESCRIPTION OF THE PREFERRED EMBODIMENT

Figure 1:
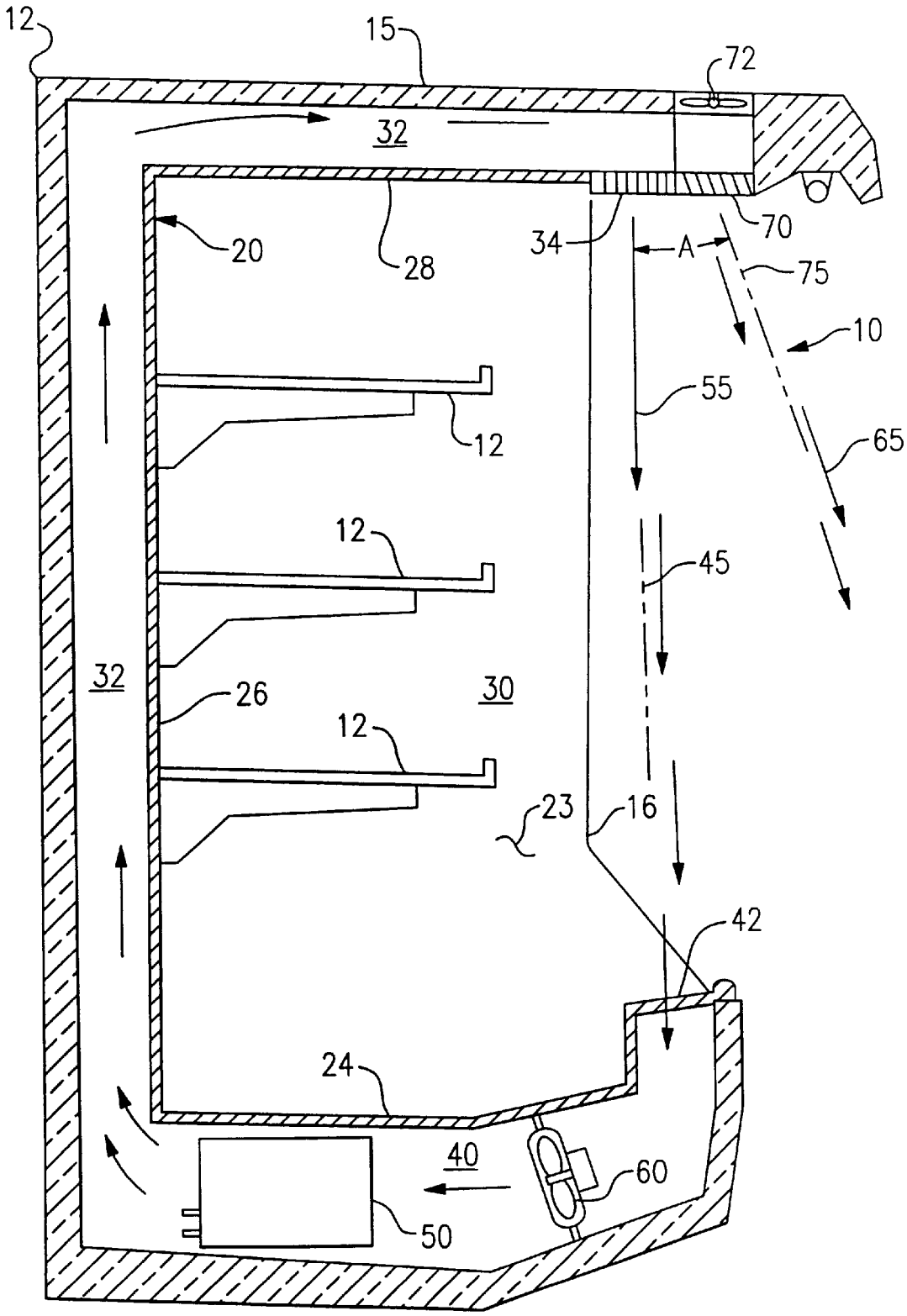
FIG. 1 illustrates a side elevation profile of a preferred embodiment of a refrigerated merchandiser having an open-front display case showing an outer warm air curtain and an inner cool air curtain directed across a product display region of the case in accordance with the present invention.

Referring now to FIG. 1, the refrigerated merchandiser 10 includes an outer cabinet 12 and an inner cabinet liner 20 that defines within its bounds an open-front product display region 30. The outer cabinet has a base 13, a rear wall 14 extending upwardly from the back of the base 13, a top wall 15 extending forwardly from the rear wall and a pair of side walls 16 extending vertically from the base 13 to the top wall 15 and forwardly from the rear wall 13. The inner cabinet liner 20 has a top panel 28, a back panel 26, a bottom panel 22 and opposed side panels 24 which together bound the open-front product display region 30. Each of the cabinet base 13, rear wall 14, top wall 15 and side walls 16 is insulated, as in conventional practice, to thermally isolate the interior of the cabinet 12, including the product display region 30, from excessive heat transfer therethrough.

Perishable product 80 being merchandized may be displayed on shelves 12 disposed within the product display region 30 and upon the upper surface of the bottom panel 24. The product display region 30 has an open front 25 so as to permit consumers to not only view, but also reach into the product display region 30 to select and remove items of product 80 that they desire to purchase. Product display region 30 is cooled in a conventional manner to a desired product temperature, typically to a temperature between −10° F. to less than about 40° F., depending upon what product is being merchandised therein and whether the product is frozen or non-frozen.

The refrigerated merchandiser 10 further includes a refrigeration compartment 40, typically disposed in the portion of the display cabinet 12 between the base 13 and the bottom panel 24, as depicted in FIG. 1, wherein components of the refrigerant system, typically a tube coil evaporator 50 and a air mover 60, such as for example one or more fans, are housed. However, it is to be understood that the specific type of air mover employed is not relevant to or limiting of the present invention. As in conventional practice, refrigerant passing through the tubes of the evaporator 40 cools air passing over the surface of the evaporator tubes. The refrigerant is typically supplied from a remote refrigeration unit located elsewhere within the store. However, it is to be understood that the present invention may also be employed on standalone refrigerated merchandisers that include their own refrigeration unit for providing the cold refrigerant.

An air circulation duct 32 is formed between the rear wall 14 and the top wall 15 of the outer cabinet 12 and the back panel 26 and top panel 28, respectively, of the inner cabinet liner 20. Air mover 60 serves to direct air from air inlet 42 through the compartment 40 so as to traverse evaporator 50, and thence through duct 32 to a first air outlet 34. As noted before, this circulating air has been cooled to a desired temperature as it traverses the evaporator 50. From the first air outlet 34, the cool refrigeration air is directed via vanes 36 provided within the first air outlet 34 downwardly along first path 45 across the open front 25 of the product display region back to air inlet 42. Thus, the refrigerating air is recycled and repeatedly recirculated through the compartment 40 and duct 32 to converse energy expended in cooling the refrigeration air. Further, through the afore-described cooling arrangement, a cool air curtain 55 is formed across the open-front product display region 30 from top to bottom thereof. To provide further cooling air directly to the product display region 30, a plurality of openings may be provided in the back panel 26 through which a portion of cold refrigerating air circulating through duct 32 may pass directly into the product display region 30. This refrigerating air will also be drawn by the air mover back through the air inlet 42 into the compartment 40 to be recirculated.

Figure 2:
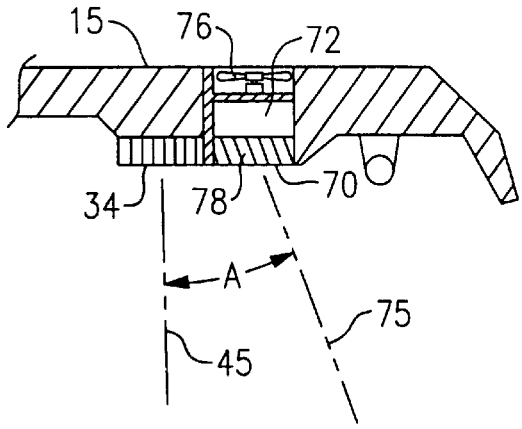
FIG. 2 illustrates a close-up view of the two outlets of the inventive display case that direct air across the product display region of the display case.
Figure 3:
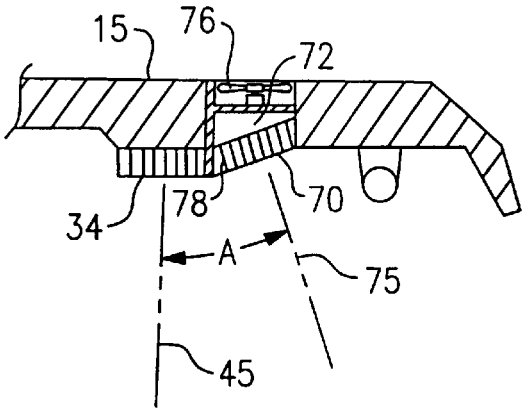
FIG. 3 illustrates a close-up view of an alternate arrangement of the two outlets shown in FIG. 2.

As shown in FIGS. 1–3, a second air outlet 70 is provided outwardly of the first air outlet 34 at the top front of the cabinet 12. In contrast to existing refrigerated merchandisers, second air outlet 70 serves to direct relatively warm air generally downwardly along a second path 75 that diverges from the first path 45 followed by the cool refrigerating air. In this manner, a relatively warm outer air curtain 65 is formed outside, i.e. further away from the product display region 30, of the relatively cool inner air curtain 55. The relatively warm outer air curtain 65 serves as a buffer between the relatively cool inner air curtain 55 and the ambient environment of the store. Further, as the relatively warm outer air curtain 65 diverges from the relatively cool inner air curtain 55 the respective air curtains pass generally downwardly, the amount of entrainment of warm air from the outer air curtain 65 into the cooler inner air curtain 55 is minimized. Further, when the outer air curtain 65 reaches the base region of the display cabinet 12, it passes outwardly into the store rather than into the air inlet 42 in the forward end of the base portion of the cabinet. 13 Consequently, the entrainment of warm air into the relatively cool inner air curtain and subsequent passage through inlet 42 into the compartment 40 is minimized, thereby reducing energy consumption in cooling the recirculating refigeration air.

As shown in greater detail in FIG. 2, the first air outlet 34 and second air outlet 70 are located at top and forward region of display case 12, with the second air outlet 70 being located outwardly of the first air outlet 34, that is, closer to the front of the display cabinet 12. As noted previously, first air outlet 34 is in communication with duct 32 and directs relatively cool air driven by air mover 60 downwardly along path 45 across open front of the product display region 30 to form the inner air curtain 55. The second air outlet 70 is in fluid communication with a source of relatively warm air and directs relatively warm air driven by a second air mover 72 associated therewith downwardly along path 75 to form an outer air curtain 65 that diverges from the inner air curtain 55.

In the embodiment depicted in FIG. 2, a plenum chamber 72 provided at the forward lip of the top wall 15 of the cabinet 12. The second air outlet 70 and an ambient air inlet 74 open into the plenum chamber 72. An air mover 76, such as an axial flow fan, is provided in operative association with the inlet 74. In operation, the air mover 74 draws ambient air from the store into and through the plenum chamber 72 and thence out the second air outlet 70 to form the relatively warm outer air curtain 65. The second air outlet 70 may, as shown in FIG. 2, lie in the same plane as the first air outlet 34. In this case, the second air outlet 70 is provided with guide vanes 78, positioned so as to direct the relatively warm air passing therethrough to form the outer air curtain 65 along path 75 so as to diverge from the inner air curtain 55 flowing along path 45. The guide vanes 78 may be adjustable such that the angle at which the second air curtain diverges from the first air curtain may be selectively adjusted within a range of preselected angles. Alternatively, as illustrated in FIG. 3, second air outlet 70 may be disposed at an angle with the first air outlet 34 and provided with axial guide vanes 78 such that the outer air curtain 65 is naturally directed to diverge away from the inner air curtain 55.

Figure 4:
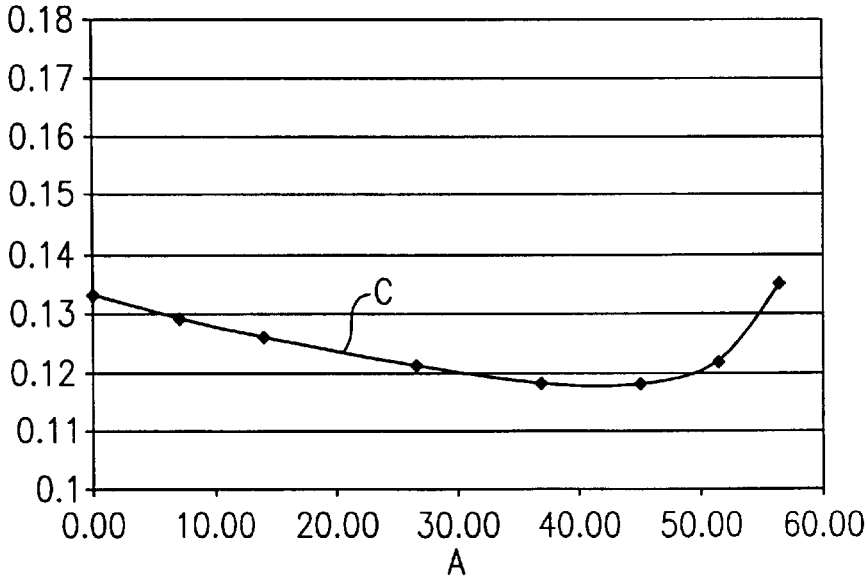
FIG. 4 illustrates graphically the variation in air curtain performance as the angle of divergence changes.

In accordance with another aspect of the present invention, the outer air curtain of relatively warmer air is directed downwardly and outwardly away from the inner air curtain at a divergent angle A of about 5 degrees to about 55 degrees, and more advantageously at a divergent angle A of about 25 degrees to about 50 degrees, and even more advantageously at an angle A about 35 degrees to about 45 degrees. Referring now to FIG. 4, the vertical axis thereof represents an entrainment factor developed to qualitatively determine the degree of entrainment of warm air into the cool air. The entrainment factor is the ratio of the difference between the measured temperature of the return air passing through the return air inlet 42 and the measured temperature of the cool refrigerated air discharging through the first air outlet 34 to the difference between the measured temperature of the warm air discharging through the second air outlet 70 and the measured temperature of the cool refrigerated air discharging through the first air outlet 34. The lower the magnitude of the entrainment factor, the lesser the degree of entrainment of warm air into the return air. The horizontal axis represents the divergent angle A, that is the included angle between the inner air curtain 55 and the outer air curtain 65 as these air curtains diverge as they flow generally downwardly from the first air outlet 34 and the second air outlet 70, respectfully. As seen in FIG. 4, the entrainment of relatively warm air into the return air stream entering the return air inlet 42 was minimized when the divergent angle A between the inner and outer air curtain was about 40 degrees. However, significant reductions in entrainment occurred over a wide range of divergent angles.

The aforementioned description is exemplary rather than limiting. Many modifications and variations of the present invention may be recognized by those skilled in the art in light of the above teachings that will fall within the spirit and scope of the present invention. The preferred embodiments of this invention have been disclosed. Accordingly, within the scope of the appended claims, the invention may be practiced otherwise than as specifically described. For this reason the following claims should be studied to determine the true scope and content of this invention.

What is claimed is:

1. A refrigerated merchandiser comprising;

a display case having an exterior and an interior, said interior defining a product display region having an open-front viewing area;

a first air outlet associated with said display case for directing a first air stream of relatively cooler air generally downwardly across the front viewing area along a first path;

a second air outlet associated with said display case for directing a second air stream of relatively warmer air generally downwardly and outwardly across the front viewing area along a second path at a divergent angle with respect to the first path.

2. A refrigerated merchandiser as recited in claim 1 wherein the divergent angle ranges form about 5 degrees to about 55 degrees.

3. A refrigerated merchandiser as recited in claim 1 wherein the divergent angle ranges form about 25 degrees to about 50 degrees.

4. A refrigerated merchandiser as recited in claim 1 wherein the divergent angle ranges form about 35 degrees to about 45 degrees.

5. A refrigerated merchandiser comprising;

a display case having an exterior and an interior, said interior defining a product display region having an open-front viewing area;

a first air outlet associated with said display case for directing a first fluid stream generally downwardly across the front viewing area along a first path; and a second air outlet associated with said display case for directing a second fluid stream generally downwardly and outwardly across the front viewing area along a second path at a divergent angle with respect to the first path.

6. A refrigerated merchandiser as recited in claim 5 wherein the divergent angle ranges form about 5 degrees to about 55 degrees.

7. A refrigerated merchandiser as recited in claim 5 wherein the divergent angle ranges form about 25 degrees to about 50 degrees.

8. A refrigerated merchandiser as recited in claim 5 wherein the divergent angle ranges form about 35 degrees to about 45 degrees.

* * * * *